US009511585B2

(12) United States Patent
Abbott, Jr. et al.

(10) Patent No.: US 9,511,585 B2
(45) Date of Patent: Dec. 6, 2016

(54) THERMAL INKJET PRINTHEAD STACK WITH AMORPHOUS THIN METAL PROTECTIVE LAYER

(71) Applicant: Hewlett-Packard Development Company, L.P., Houston, TX (US)

(72) Inventors: James Elmer Abbott, Jr., Corvallis, OR (US); Arun K. Agarwal, Corvallis, OR (US); Roberto A. Pugliese, Corvallis, OR (US); Greg Scott Long, Corvallis, OR (US); Stephen Horvath, San Diego, CA (US); Douglas A. Keszler, Corvallis, OR (US); John Wager, Corvallis, OR (US); Kristopher Olsen, Corvallis, OR (US); John McGlone, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/787,711

(22) PCT Filed: Jul. 12, 2013

(86) PCT No.: PCT/US2013/050203
§ 371 (c)(1),
(2) Date: Oct. 28, 2015

(87) PCT Pub. No.: WO2015/005933
PCT Pub. Date: Jan. 15, 2015

(65) Prior Publication Data
US 2016/0075136 A1 Mar. 17, 2016

(51) Int. Cl.
*B41J 2/14* (2006.01)
*B41J 2/16* (2006.01)

(52) U.S. Cl.
CPC ..... *B41J 2/14112* (2013.01); *B41J 2/14088* (2013.01); *B41J 2/14129* (2013.01);
(Continued)

(58) Field of Classification Search
CPC ..... B41J 2/14; B41J 2/14016; B41J 2/14088; B41J 2/14112; B41J 2/14129
See application file for complete search history.

(56) References Cited

U.S. PATENT DOCUMENTS 4,288,302 A 9/1981 de Nora et al.
4,335,389 A 6/1982 Shirato et al.
(Continued)

FOREIGN PATENT DOCUMENTS

CN 101533876 9/2009
JP S556497 1/1980
(Continued)

OTHER PUBLICATIONS

Baker et al., High-Temperature Oxidation Behavior of a New Ni—Cr—Mo—Si Alloy, Jan. 2, 2013, http://www.specialmetals.com/documents/High%20Temperature%20Oxidation%20behavior%20of%20a%20new%20NiCrMoSi%20Alloy.pdf.
(Continued)

*Primary Examiner* — Geoffrey Mruk
(74) *Attorney, Agent, or Firm* — HP Inc—Patent Department

(57) ABSTRACT

The present disclosure is drawn to a thermal inkjet printhead stack with an amorphous thin metal protective layer, comprising an insulated substrate, a resistor applied to the insulated substrate, a resistor passivation layer applied to the resistor, and an amorphous thin metal protective layer applied to the resistor passivation layer. The amorphous thin metal protective layer can comprise from 5 atomic % to 90 atomic % of a metalloid of carbon, silicon, or boron. The
(Continued)

film can also include a first and second metal, each comprising from 5 atomic % to 90 atomic % of titanium, vanadium, chromium, cobalt, nickel, zirconium, niobium, molybdenum, rhodium, palladium, hafnium, tantalum, tungsten, iridium, or platinum. The second metal is different than the first metal, and the metalloid, the first metal, and the second metal account for at least 70 atomic % of the amorphous thin metal protective layer.

18 Claims, 2 Drawing Sheets

(52) U.S. Cl.
CPC ..... *B41J 2/164* (2013.01); *B41J 2/1646* (2013.01); *B41J 2/1648* (2013.01); *B41J 2/14016* (2013.01); *B41J 2202/03* (2013.01); *B41J 2202/11* (2013.01)

(56) References Cited

U.S. PATENT DOCUMENTS

| | | | |
|---|---|---|---|
| 5,479,197 | A | 12/1995 | Fujikawa et al. |
| 5,790,154 | A | 8/1998 | Mitani et al. |
| 5,966,153 | A | 10/1999 | Mitani et al. |
| 6,142,612 | A | 11/2000 | Whitman |
| 6,175,377 | B1 | 1/2001 | Noshita et al. |
| 6,198,143 | B1 | 3/2001 | Ohsaki |
| 6,299,294 | B1 | 10/2001 | Regan |
| 6,645,560 | B2 | 11/2003 | Zhao et al. |
| 6,715,859 | B2 | 4/2004 | Pan |
| 6,769,762 | B2 | 8/2004 | Saito et al. |
| 2008/0259131 | A1 | 10/2008 | Cornell et al. |
| 2011/0310183 | A1 | 12/2011 | Tamaru et al. |
| 2012/0156395 | A1 | 6/2012 | Bilello |
| 2013/0162724 | A1 | 6/2013 | Pugliese, Jr. et al. |

FOREIGN PATENT DOCUMENTS

| | | |
|---|---|---|
| JP | H08209327 | 8/1996 |
| JP | H10202889 | 8/1998 |
| JP | H11186035 | 7/1999 |
| JP | 2000318196 | 11/2000 |

OTHER PUBLICATIONS

International Search Report and Written Opinion dated Apr. 23, 2014 issued on PCT Patent Application No. PCT/US2013/050203 dated Jul. 12, 2013, Korean Intellectual Property Office.

Nishiyama et al., A Prominent Ni—Cr—Si—Cu Alloy Resisting in Metal Dusting, Mar. 13-17, 2011, http://journals.cambridge.org/action/displayAbstract;jsessionid=07E4EBFC289DC376708FCE7D1EFDBA1E.journals?fromPage=online&aid=8177368.

Saris et al., Stability of Thin Film Amorphous Metal Alloys, 1998, vol. 54, http://journals.cambridge.org/action/displayAbstract;jsessionid=07E4EBFC289DC376708FCE7D1EF.

THERMAL INKJET PRINTHEAD STACK WITH AMORPHOUS THIN METAL PROTECTIVE LAYER

CLAIM FOR PRIORITY

The present application is a national stage filing under 35 U.S.C. §371 of PCT application number PCT/US2013/050203, having an international filing date of Jul. 12, 2013, the disclosure of which is hereby incorporated by reference in its entirety.

BACKGROUND

Thin metal films can be used in various applications such as electronic semiconductor devices, optical coatings, and printing technologies. As such, once deposited, thin metal films can be subjected to harsh environments. Such thin films may be subjected to high heat, corrosive chemicals, etc.

For example, in a typical inkjet printing system, an inkjet printhead ejects fluid (e.g., ink) droplets through a plurality of nozzles toward a print medium, such as a sheet of paper, to print an image onto the print medium. The nozzles are generally arranged in one or more arrays, such that properly sequenced ejection of ink from the nozzles causes characters or other images to be printed on the print medium as the printhead and the print medium are moved relative to each other.

Unfortunately, because the ejection process is repeated thousands of times per second during printing, collapsing vapor bubbles also have the adverse effect of damaging the heating element. The repeated collapsing of the vapor bubbles leads to cavitation damage to the surface material that coats the heating element. Each of the millions of collapse events ablate the coating material. Once ink penetrates the surface material coating the heating element and contacts the hot, high voltage resistor surface, rapid corrosion and physical destruction of the resistor soon follows, rendering the heating element ineffective. There are also other examples of systems, outside of the inkjet arts, where structures may undergo contact with harsh environments. As such, research and development continues in the area of thin metal films used in various applications that can provide improved performance.

BRIEF DESCRIPTION OF THE DRAWINGS

Additional features and advantages of the disclosure will be apparent from the detailed description which follows, taken in conjunction with the accompanying drawings, which together illustrate, by way of example, features of the present technology.

Figure 1:
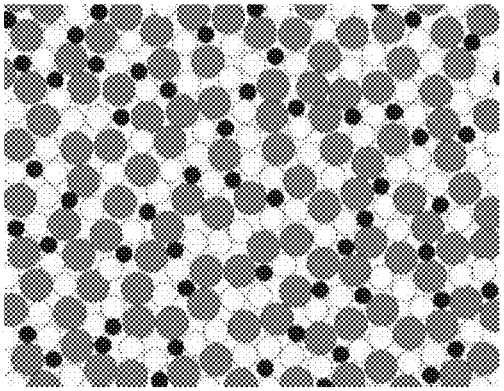
FIG. 1 is a figure of a schematic cross-sectional view of a distribution of elements of a three component amorphous thin metal film in accordance with one example of the present disclosure.

Reference will now be made to the exemplary embodiments illustrated, and specific language will be used herein to describe the same. It will nevertheless be understood that no limitation of the scope of the disclosure is thereby intended.

DETAILED DESCRIPTION

Before the present technology is disclosed and described, it is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present technology is intended to be limited only by the appended claims and equivalents thereof.

It has been recognized that it would be advantageous to develop amorphous thin metal films that are stable, having robust chemical, thermal, and mechanical properties. Specifically, it has been recognized that many thin metal films generally have a crystalline structure that possess grain boundaries and a rough surface. Notably, such characteristics hamper the thin metal film's chemical, thermal, and mechanical properties. However, thin metal films can be made from a three or four (or more) component system providing a stable and amorphous structure having improved chemical, thermal, and mechanical properties.

In accordance with this, the present disclosure is drawn to a thermal inkjet printhead stack with an amorphous thin metal protective layer. The stack can comprise an insulated substrate, a resistor applied to the insulated substrate, a resistor passivation layer applied over the resistor, and an amorphous thin metal protective layer applied over the resistor passivation layer. The amorphous thin metal protective layer can comprise from 5 atomic % to 90 atomic % of a metalloid of carbon, silicon, or boron; from 5 atomic % to 90 atomic % of a first metal of titanium, vanadium, chromium, cobalt, nickel, zirconium, niobium, molybdenum, rhodium, palladium, hafnium, tantalum, tungsten, iridium, or platinum; and from 5 atomic % to 90 atomic % of a second metal of titanium, vanadium, chromium, cobalt, nickel, zirconium, niobium, molybdenum, rhodium, palladium, hafnium, tantalum, tungsten, iridium, or platinum. The second metal in this example is different than the first metal. The metalloid, the first metal, and the second metal can account for at least 70 atomic % of the amorphous thin metal film. Alternatively, two components of the metalloid, the first metal, and the second metal can account for at least 70 atomic % of the amorphous thin metal film. In yet another example, the metalloid, the first metal, and the second metal can account for at least 90 atomic %, or even 100 atomic % of the amorphous thin metal film. Furthermore, in each of the above ranges, e.g., for the metalloid, the first metal, and/or the second metal, the lower end of the range can be modified independently to 10 atomic %, or 20 atomic %. Likewise, the upper end of these ranges can be modified independently to 85 atomic %, 80 atomic %, or 70 atomic %.

A method of manufacturing a thermal inkjet printhead stack is also disclosed. The method can comprise applying an amorphous thin metal protective layer to a passivation-layer coated thermal inkjet resistor to provide chemical protection for the resistor. The amorphous thin metal protective layer can be of the same material described above, e.g., the metalloid, the first metal, and the second metal as part of an amorphous film. The step of depositing can include sputtering, atomic layer deposition, chemical vapor deposition, electron beam evaporation, or thermal evaporation. In one example, the step of applying an amorphous thin metal protective layer to a passivation layer-coated resistor includes mixing the metalloid, the first metal, and the second metal form a blend and sputtering the blend onto the insulated substrate. With specific reference to sputtering, this can be carried out, for example, at 5 to 15 mTorr at a deposition rate of 5 to 10 nm/min with the target approximately 4 inches from a stationary substrate. Other deposition conditions may be used and other deposition rates can be achieved depending on variables such as target size, electrical power used, pressure, sputter gas, target to substrate spacing and a variety of other deposition system dependent variables. In another aspect, depositing can be performed in the presence of a dopant that is incorporated into the thin film. In another specific aspect, the dopant can be oxygen and/or nitrogen.

In each of these examples, from 5 atomic % to 85 atomic % of a third metal can be present as well, and can include metals such as titanium, vanadium, chromium, cobalt, nickel, zirconium, niobium, molybdenum, rhodium, palladium, hafnium, tantalum, tungsten, iridium, or platinum. In this example, the third metal is different than the first metal and the second metal. This range of metalloid, first metal, second metal, and third metal can likewise be independently modified at the lower end to 10 atomic %, or 20 atomic %, and/or at the upper end to 80 atomic %, or 70 atomic %. Furthermore, in one example, the metalloid, the first metal, the second metal, and the third metal can account for at least 80 atomic %, at least 90 atomic %, or even 100 atomic % of the amorphous thin metal film.

The thermal printhead stack can also comprise pair of conductors electrically coupled with the resistor. In this example, the pair of conductors may also include passivation layers, respectively, applied to a top surface of the pair of conductors. Thus, when both the conductors are coated with dielectric or passivation layers, a common passivation or electrically insulating film can be used for both the conductors and the resistor, or separate material coating layers can be used.

With specific reference to the material used to prepare the amorphous thin metal protective layer, three or four (or more) component amorphous blends can be prepared. As mentioned, one of the components can be a metalloid, and the other two or three components can be a Group IV, V, VI, IX, or X (4, 5, 6, 9, or 10) metals. These three or four component mixtures of elements can be blended in a manner and in quantities that the mixture is homogenous when applied to the substrate. Additionally, the mixture can be applied to a suitable substrate using any of a number of deposition techniques, as mentioned. By using these three or four (or more) components in high enough concentrations, a "confusion" of sizes and properties disfavors the formation of lattice structures that are more typical in single component or even two component systems. Selecting components with suitable size differentials can contribute to minimizing crystallization of the structure. For example, the amorphous thin metal protective layer may have an atomic dispersity of at least 12% between two of the elements. In another aspect, the amorphous thin metal protective layer may possess an atomic dispersity of at least 12% between three of elements, e.g., metalloid, first metal, and second metal. As used herein, "atomic dispersity" refers to the difference in size between the radii of two atoms. In one example, the atomic dispersity can be at least 15%, and in one aspect, can be at least 20%. The atomic dispersity between components can contribute to the desirable properties of the present films, including thermal stability, oxidative stability, chemical stability, and surface roughness, which are not achieved by some other thin metal films. Oxidative stability can be measured by the amorphous thin metal film's oxidation temperature and/or oxide growth rate as discussed herein.

In many thin film stacks, tantalum (Ta) is commonly used, such as for certain top coatings, as it is chemically resistant to many inks and also resists mechanical cavitation forces from bubble collapse. However, in most thin film applications, tantalum and other metals are deposited in a crystalline form. This leads to grain boundaries and an intrinsically rough surface. Oxide growth in crystalline materials typically follows these grain boundaries, and film consumption by oxidation is one major failure mode of inkjet resistor film stacks capped with crystalline metals. In addition, grain boundaries can promote crack propagation and limit mechanical robustness. Thus, it has been recognized that amorphous thin metal protective layer(s), such as those described herein, can be used that are very heat and chemical resistant, and thus, can be used instead of crystalline tantalum coatings. Because of the improved properties of the materials of the present disclosure, as described herein, a more robust coating can lead to improved time or number of ink firings from manufacture to failure.

Figure 2:
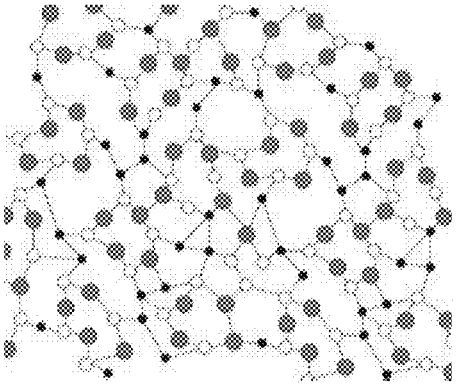
FIG. 2 is a figure of a lattice structure of a three component amorphous thin metal film in accordance with one example of the present disclosure.
Figure 3:
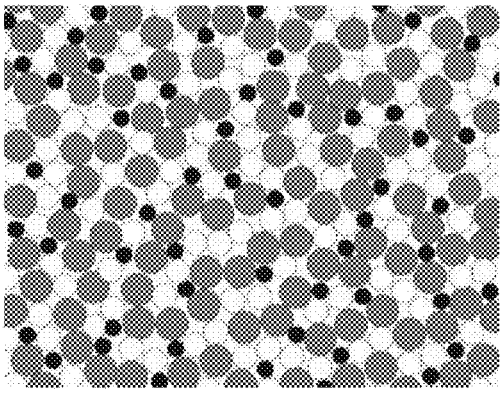
FIG. 3 is a figure of a schematic cross-sectional view of a distribution of elements of a four component amorphous thin metal film in accordance with one example of the present disclosure.
Figure 4:
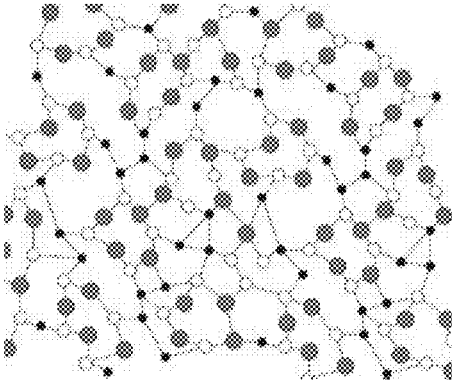
FIG. 4 is a figure of a lattice structure of a four component amorphous thin metal film in accordance with one example of the present disclosure.

Turning now to FIGS. 1 and 3, the present amorphous thin metal protective layers (three and four component films, respectively) can have a distribution of components with a desirable atomic dispersity. Notably, the present amorphous thin metal protective layers can be generally amorphous with a smooth, grain-free structure. Turning now to FIGS. 2 and 4, the lattice structure of two exemplary amorphous thin metal protective layers are represented, which are non-crystalline. More crystalline structures tend to have more defined grain boundaries, which can be less desirable for chemical resistivity, particularly in an inkjet thermal system which undergoes both high temperature (for jetting) and chemical attack (from the ink), simultaneously. It is noted that FIGS. 1-4 are presented theoretically. Similarities between the three and four component systems is not intended to infer identical general structures, bonding sites, bonding lengths, etc. Thus, it is understood that these FIGS. are schematic in nature only and are presented for purposes of depicting the general amorphous nature of the various structures, and not to infer similarly between two specific amorphous films.

As discussed herein, the present amorphous thin metal protective layers can have exceptional properties including thermal stability, oxidative stability, low surface roughness, and suitable resistivity for thermal inkjet applications. In one example, the present amorphous thin metal protective layers can have a root mean square (RMS) roughness of less than 1 nm. In one aspect, the RMS roughness can be less than 0.5 nm. In another aspect, the RMS roughness can be less than 0.1 nm. One method to measure the RMS roughness includes measuring atomic force microscopy (AFM) over a 100 nm by 100 nm area. In other aspects, the AFM can be measured over a 10 nm by 10 nm area, a 50 nm by 50 nm area, or a 1 micron by 1 micron area. Other light scattering techniques can also be used such as x-ray reflectivity or spectroscopic ellipsometry.

In another example, the amorphous thin metal protective layer can have a thermal stability of at least 400° C. In one aspect, the thermal stability can be at least 800° C. In another aspect, the thermal stability can be at least 900° C. As used herein, "thermal stability" refers to the maximum temperature that the amorphous thin metal protective layer can be heated while maintaining an amorphous structure. One method to measure the thermal stability includes sealing the amorphous thin metal film in a quartz tube, heating the tube to a temperature, and using x-ray diffraction to evaluate the atomic structure and degree of atomic ordering.

In still another example, the amorphous thin metal protective layer can have an oxidation temperature of at least 700° C. In one aspect, the oxidation temperature can be at least 800° C., and in another aspect, at least 1000° C. As used herein, the oxidation temperature is the maximum temperature that the amorphous thin metal film can be exposed before failure of the thin film due to stress creation and embrittlement of the partially or completely oxidized thin film. One method to measure the oxidation temperature is to heat the amorphous thin metal film at progressively increasing temperatures in air until the thin film cracks and flakes off the substrate.

In another example, the amorphous thin metal protective layer can have an oxide growth rate of less than 0.05 nm/min. In one aspect, the oxide growth rate can be less than 0.04 nm/min, or in another aspect, less than 0.03 nm/min. One method to measure the oxide growth rate is to heat the amorphous thin metal film under air (20% oxygen) at a temperature of 300° C., measure the amount of oxidation on the amorphous thin metal film using spectroscopic ellipsometry periodically, and average the data to provide a nm/min rate. Depending on the components and the method of manufacture, the amorphous thin metal film can have a wide range of electric resistivity, including ranging from 100 μΩ·cm to 2000 μΩ·cm.

Generally, the amorphous thin metal protective layer can have a negative heat of mixing. As discussed herein, the present thin metal films generally include a metalloid, a first metal, and a second metal, where the first and second metal can include elements selected from Periodic Table Groups IV, V, VI, IX, and X (4, 5, 6, 9, and 10). In one example, the amorphous thin metal films can include a refractory metal selected from the group of titanium, vanadium, chromium, zirconium, niobium, molybdenum, rhodium, hafnium, tantalum, tungsten, and iridium. In one aspect, the first and/or second metal can be present in the thin film in an amount ranging from 20 at % to 90 at %. In another aspect, the first and/or second metal can be present in the thin film in an amount ranging from 20 at % to 40 at %.

Additionally, the amorphous thin metal protective layer can further include a dopant. In one example, the dopant can include nitrogen, oxygen, and mixtures thereof. The dopant can generally be present in the amorphous thin metal film in an amount ranging from 0.1 at % to 15 at %. In one example, the dopant can be present in an amount ranging from 0.1 at % to 5 at %. Smaller amounts of dopants can also be present, but at such low concentrations, they would typically be considered impurities. Additionally, in one aspect, the amorphous thin metal film can be devoid of aluminum, silver, and gold.

Generally, the amorphous thin metal protective layer can have a thickness ranging from 10 angstroms to 100 microns. In one example, the thickness can be from 10 angstroms to 2 microns. In one aspect, the thickness can be from 0.05 microns to 0.5 microns.

Figure 5:
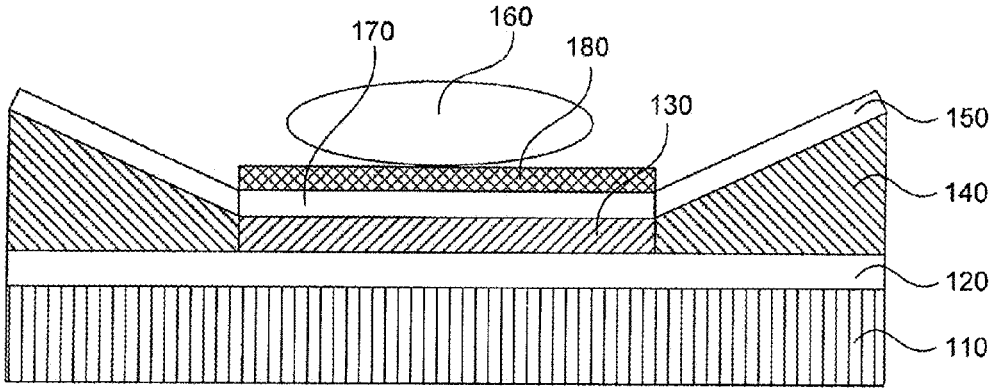
FIG. 5 is a cross-sectional schematic view of a portion of a thermal inkjet printhead stack in accordance with an example of the present disclosure.

Turning now to FIG. 5, an example structure is shown that would be suitable for a thin film stack for use in a thermal inkjet printhead. Specifically, a silicon wafer 110 is shown having an electrical insulating layer 120 applied thereto. To the insulating layer is applied the resistor 130, which can be prepared using any known resistor material known in the thermal inkjet printing arts, such as TaAl, WSiN, TaSiN, or $Ta_2O_5$. A suitable average thickness for the resistor can be from 0.02 microns to 0.5 microns, though thicknesses outside of this range can also be used. Furthermore, the resistor, as described, can be doped with any material suitable for achieving desired electrical properties, including, but not limited to, resistivity. The resistor is likewise in electrical communication with a pair of conductors 140 positioned on either side of the resistor. These conductors can act as electrodes for the resistor. In this example, the conductors are also applied to the insulating layer, though this arrangement is merely exemplary. The conductors can be of any material known in the art, but in one example, the conductors can be aluminum, or an alloy of aluminum and copper.

Furthermore, conductor passivation layers 150, which are also insulating, are applied to the conductors to prevent contact between the ink 160 and the conductors. A suitable average thickness for the conductors can be from 0.1 micron to 2 microns, and a suitable average thickness for the passivation layers can be from 0.02 micron to 1 micron, though thicknesses outside of this range can also be suitable.

To the resistor 130, a resistor passivation layer 170 can likewise be applied. This film can be relatively thin to relatively thick, e.g., from 50 angstroms to 2500 angstroms, from 50 angstroms to 1000 angstroms, from 100 angstroms to 1000 angstroms, from 100 angstroms to 500 angstroms, from 100 angstroms to 200 angstroms, etc. To the resistor passivation layer is applied an amorphous thin metal protective layer 180. Any of the materials described herein that comprise a metalloid (Si, C, or B) and two or more metals of Groups IV, V, VI, IX, and X can be selected for use for the resistor.

Insulating materials that can be used for the electrical insulating layer 120, the conductor passivation layers 150, and the resistor passivation layer 170, or any other insulating layer can be $SiO_2$, SiN, $Al_2O_3$, $HfO_2$, $ZrO_2$, or undoped silicate glass, for example. The electrical insulating films or passivation layers, for example, can be formed by thermal oxidation of the resistor or conductors or deposition of an electrically insulating thin film. Also, it is noted that the resistor passivation layer and the conductor passivation layers 150 can be integrated as a single layer, or may remain as separate, adjacent layers. It is noted that many other types or positioning of layers can also be used as would be appreciated by one skilled in the art after considering the present disclosure.

It is noted that, as used in this specification and the appended claims, the singular forms "a," "an," and "the" include plural referents unless the context clearly dictates otherwise.

As used herein, "devoid of" refers to the absence of materials in quantities other than trace amounts, such as impurities.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 at % to about 5 at %" should be interpreted to include not only the explicitly recited values of about 1 at % to about 5 at %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

EXAMPLES

The following examples illustrate embodiments of the disclosure that are presently known. Thus, these examples should not be considered as limitations of the disclosure, but are merely in place to teach how to make thermal inkjet printheads presently known. As such, a representative number of compositions, amorphous thin film stacks, and their method of manufacture are disclosed herein.

Example 1

Amorphous Thin Metal Protective Layers

Various amorphous thin metal protective layers were prepared by DC and RF sputtering at 5 mTorr to 15 mTorr under argon, RF at 50 W to 100 W, and DC at 35 W to 55 W on to a silicon wafer. The resulting film thickness was in the range of 100 nm to 500 nm. The specific components and amounts are listed in Table 1.

TABLE 1

| Amorphous Thin Metal Protective Layers | Ratio (atomic %) | Ratio* (weight %) |
|---|---|---|
| TaNiSi | 40:40:20 | 71:23:6 |
| TaWSi | 40:40:20 | 48:49:4 |
| TaWSi | 30:50:20 | 36:61:4 |
| TaMoSi | 40:40:20 | 62:33:5 |
| TaPtSi | 40:40:20 | 46:50:4 |
| TaWNiSi | 35:35:10:20 | 45:46:4:4 |

*Weight ratio calculated from atomic % and rounded to the nearest integer

Example 2

Amorphous Thin Metal Protective Layers

Various amorphous thin metal protective layers are prepared by DC and RF sputtering at 5 mTorr to 15 mTorr under argon, RF at 50 W to 100 W, and DC at 35 W to 55 W on to a silicon wafer. The resulting film thickness is in the range of 100 nm to 500 nm. The specific components and amounts are listed in Table 2.

TABLE 2

| Amorphous Thin Metal Protective Layers | Ratio (atomic %) | Ratio* (weight %) |
|---|---|---|
| TaCoB | 60:30:10 | 85:14:1 |
| NbWB | 50:40:10 | 38:61:1 |
| MoPtC | 40:50:10 | 28:71:1 |
| WTiC | 30:40:30 | 71:25:5 |
| MoNiSi | 45:40:5 | 63:35:2 |
| TaWNiB | 35:35:10:20 | 47:47:4:2 |

*Weight ratio calculated from atomic % and rounded to the nearest integer

Example 3

Amorphous Thin Metal Protective Layer Properties

The amorphous thin metal protective layers of Example 1 were tested for electrical resistivity, thermal stability, chemical stability, oxidation temperature, oxide growth rate. The results are listed in Table 3. All of the films had a surface RMS roughness of less than 1 nm.

Surface RMS roughness was measured by atomic force microscopy (AFM). Electrical resistivity was measured by collinear four point probe for different deposition conditions providing the range listed in Table 3. Thermal Stability was measured by sealing the amorphous thin metal protective layers in a quartz tube at approximately 50 mTorr and annealing up to the temperature reported with x-ray confirmation of the amorphous state, where the x-ray diffraction patterns showed evidence of Bragg reflections. Chemical stability was measured by immersing the amorphous thin metal protective layers in Hewlett Packard commercial inks CH602SERIES, HP Bonding Agent for Web Press; CH585SERIES, HP Bonding Agent for Web Press; and CH598SERIES, HP Black Pigment Ink for Web Press; at 70° C. and checked at 2 and 4 weeks. Adequate chemical stability was present with the amorphous thin metal protective layers when it showed no visual physical change or delamination, indicated by a "Yes" in Table 3. Oxidation temperature was measured as the maximum temperature that the amorphous thin metal protective layers can be exposed before failure of the thin film due to stress creation and embrittlement of the partially or completely oxidized thin film. Oxide growth rate was measured by heating the amorphous thin metal protective layers under air (20% oxygen) at a temperature of 300° C., measuring the amount of oxidation on the amorphous thin metal film using spectroscopic ellipsometry periodically over a periods of 15, 30, 45, 60, 90, and 120 minutes, and then at 12 hours, and averaging the data to provide a nm/min rate.

TABLE 3

| Amorphous Thin Metal Protective Layers | Ratio (at. %) | Electric Resistivity (μΩ · cm) | Thermal Stability (° C.) | Chemical Stability | Oxidation Temperature (° C.) | Oxide Growth Rate (nm/min) |
|---|---|---|---|---|---|---|
| TaNiSi | 40:40:20 | 230-440 | 500 | Yes | 700 | 0.035 |
| TaWSi | 40:40:20 | 210-255 | 900 | Yes | 1000 | 0.027* |

TABLE 3-continued

| Amorphous Thin Metal Protective Layers | Ratio (at. %) | Electric Resistivity (μΩ · cm) | Thermal Stability (° C.) | Chemical Stability | Oxidation Temperature (° C.) | Oxide Growth Rate (nm/min) |
|---|---|---|---|---|---|---|
| TaWSi | 30:50:20 | 210-1500 | 900 | Yes | Not tested | 0.049* |
| TaMoSi | 40:40:20 | 165-1000 | 900 | Yes | Not tested | 0.132* |
| TaPtSi | 40:40:20 | 300 | 400 | Yes | Not tested | 0 |
| TaWNiSi | 35:35:10:20 | 200-440 | 800 | Yes | 800 | 0.039* |

*Showed evidence of passivation (decreased growth rate) after appox. 60 minutes

While the disclosure has been described with reference to certain embodiments, those skilled in the art will appreciate that various modifications, changes, omissions, and substitutions can be made without departing from the spirit of the disclosure. It is intended, therefore, that the disclosure be limited only by the scope of the following claims.

What is claimed is:

1. A thermal inkjet printhead stack with an amorphous thin metal protective layer, comprising:

an insulated substrate;

a resistor applied to the insulated substrate;

a resistor passivation layer applied to the resistor; and an amorphous thin metal protective layer applied to the resistor passivation layer, the amorphous thin metal protective layer, comprising:

5 atomic % to 90 atomic % of a metalloid, wherein the metalloid is carbon, silicon, or boron, 5 atomic % to 90 atomic % of a first metal, wherein the first metal is titanium, vanadium, chromium, cobalt, nickel, zirconium, niobium, molybdenum, rhodium, palladium, hafnium, tantalum, tungsten, iridium, or platinum, and 5 atomic % to 90 atomic % of a second metal, wherein the second metal is titanium, vanadium, chromium, cobalt, nickel, zirconium, niobium, molybdenum, rhodium, palladium, hafnium, tantalum, tungsten, iridium, or platinum, wherein the second metal is different than the first metal, wherein the metalloid, the first metal, and the second metal account for at least 70 atomic % of the amorphous thin metal protective layer.

2. The thermal inkjet printhead stack of claim 1, wherein the amorphous thin metal protective layer further comprises from 5 atomic % to 85 atomic % of a third metal, wherein the third metal is titanium, vanadium, chromium, cobalt, nickel, zirconium, niobium, molybdenum, rhodium, palladium, hafnium, tantalum, tungsten, iridium, or platinum, and wherein the second metal is different than the first metal and the second metal.

3. The thermal inkjet printhead stack of claim 1, further comprising a pair of conductors electrically coupled with the resistor, the pair of conductors also including conductor passivation layers applied to a top surface of the pair of conductors.

4. The thermal inkjet printhead stack of claim 1, wherein the amorphous thin metal protective layer further comprises from 0.1 atomic % to 15 atomic % of a dopant, the dopant being nitrogen, oxygen, or mixtures thereof.

5. The thermal inkjet printhead stack of claim 1, wherein the amorphous thin metal protective layer has a surface RMS roughness of less than 1 nm.

6. The thermal inkjet printhead stack of claim 1, wherein the amorphous thin metal protective layer has a thermal stability of at least 400° C. and has an oxidation temperature of at least 700° C.

7. The thermal inkjet printhead stack of claim 1, wherein the amorphous thin metal protective layer has an oxide growth rate of less than 0.05 nm/min.

8. The thermal inkjet printhead stack of claim 1, wherein the amorphous thin metal protective layer has an atomic dispersity of at least 12% between at least two of the metalloid, the first metal, and the second metal relative to one another.

9. The thermal inkjet printhead stack of claim 1, wherein the amorphous thin metal protective layer has an atomic dispersity of at least 12% between each of the metalloid, the first metal, and the second metal relative to one another.

10. The thermal inkjet printhead stack of claim 1, wherein the amorphous thin metal protective layer is applied at a thickness ranging from 0.8 micron to 2 microns.

11. A method of manufacturing a thermal inkjet printhead stack with an amorphous thin metal protective layer, comprising:

applying an amorphous thin metal protective layer to a passivation-layer coated thermal inkjet resistor to provide chemical protection for the resistor, the amorphous thin metal protective layer, comprising:

5 atomic % to 90 atomic % of a metalloid, wherein the metalloid is carbon, silicon, or boron;

5 atomic % to 90 atomic % of a first metal, wherein the first metal is titanium, vanadium, chromium, cobalt, nickel, zirconium, niobium, molybdenum, rhodium, palladium, hafnium, tantalum, tungsten, iridium, or platinum; and 5 atomic % to 90 atomic % of a second metal, wherein the second metal is titanium, vanadium, chromium, cobalt, nickel, zirconium, niobium, molybdenum, rhodium, palladium, hafnium, tantalum, tungsten, iridium, or platinum, and wherein the second metal is different than the first metal.

12. The method of claim 11, wherein the step of applying the amorphous thin metal protective layer includes:

mixing the metalloid, the first metal, and the second metal form a blend, and sputtering the blend onto the insulated substrate.

13. The method of claim 11, wherein the amorphous thin metal protective layer further comprises from 5 atomic % to 85 atomic % of a third metal, wherein the third metal is titanium, vanadium, chromium, cobalt, nickel, zirconium, niobium, molybdenum, rhodium, palladium, hafnium, tantalum, tungsten, iridium, or platinum, wherein the second metal is different than the first metal and the second metal.

14. The method of claim 11, wherein the amorphous thin metal protective layer is applied at a thickness ranging from 0.8 micron to 2 microns.

15. The method of claim 11, wherein the amorphous thin metal protective layer has a surface RMS roughness of less than 1 nm, a thermal stability of at least 400° C., an oxidation temperature of at least 700° C., and an oxide growth rate of less than 005 nm/min.

16. A thermal inkjet printhead stack with an amorphous thin metal protective layer, comprising:

an insulated substrate;

a resistor applied to the insulated substrate;

a pair of conductors positioned on each side of the resistor and electrically coupled with the resistor;

at least one passivation layer applied to a top surface of the resistor and a top surface of the each of the pair of conductors;

an amorphous thin metal protective layer applied to the at least one passivation layer and disposed over the resistor, the amorphous thin meta protective layer being electrically insulated from the resistor by the at least one passivation layer, and the amorphous thin metal protective layer comprising:

5 atomic % to 90 atomic % of a metalloid, wherein the metalloid is carbon, silicon, or boron, 5 atomic % to 90 atomic % of a first metal, wherein the first literal is titanium, vanadium, chromium, cobalt, nickel, zirconium, niobium, molybdenum, rhodium, palladium, hafnium, tantalum, tungsten, iridium, or platinum, and 5 atomic % to 90 atomic % of a second metal, wherein the second metal is titanium, vanadium, chromium, cobalt, nickel, zirconium, niobium, molybdenum, rhodium, palladium, hafnium, tantalum, tungsten, iridium, or platinum, wherein the second metal is different than the first metal, wherein the metalloid, the first metal, and the second metal account for at least 70 atomic % of the amorphous thin metal protective layer.

17. The thermal inkjet printhead stack of claim 16, wherein the amorphous thin metal protective layer has a thickness of greater than 0.8 micron.

18. The thermal inkjet printhead stark of claim 17, wherein the resistor has a thickness range of 0.02 micron to 0.5 micron.

* * * * *